United States Patent [19]

Reynolds

[11] Patent Number: 5,018,326

[45] Date of Patent: May 28, 1991

[54] BUILDING SYSTEM

[75] Inventor: Donald A. Reynolds, Baildon, United Kingdom

[73] Assignee: Don Reynolds International Limited, Bradford, United Kingdom

[21] Appl. No.: 435,004

[22] Filed: Nov. 9, 1989

[30] Foreign Application Priority Data

Nov. 11, 1988 [GB] United Kingdom ..... 8826426

[51] Int. Cl.[5] ..... E06B 3/62

[52] U.S. Cl. ..... 52/235; 52/207; 52/397

[58] Field of Search ..... 52/202, 235, 476, 208, 52/207, 208, 397, 400, 403; 49/381, 402

[56] References Cited

U.S. PATENT DOCUMENTS

| | | | |
|---|---|---|---|
| 2,578,470 | 12/1951 | Gorell et al. | 52/202 |
| 2,847,724 | 8/1958 | Blood | 52/476 |
| 4,314,424 | 2/1982 | Gordon et al. | 52/208 |
| 4,631,884 | 12/1986 | Reynolds | 52/235 |
| 4,878,314 | 11/1989 | Blockinger | 49/381 |

FOREIGN PATENT DOCUMENTS

| | | | |
|---|---|---|---|
| 53590 | 9/1937 | Denmark | 49/402 |
| 1146154 | 3/1969 | United Kingdom | 49/381 |

*Primary Examiner*—James L. Ridgill, Jr.
*Attorney, Agent, or Firm*—Darby & Darby

[57] ABSTRACT

An opening window for use with curtain wall systems comprising an outer frame adapted to fit to the framework members of the curtain wall system and an inner frame bearing the glazed portion of the window, the inner frame and the outer frame being hingedly attached to one another and the glazed portion extending so as to be substantially coextensive with the outer frame. The appearance of this window does not detract from the sight lines of the building and yet the flexibility of the system is not impaired.

5 Claims, 4 Drawing Sheets

BUILDING SYSTEM

This invention relates to a curtain wall system for the cladding of buildings and in particular relates to the provision of opening windows for such systems.

In our U.S. Pat. No. 4,631,884 there is described a novel wall system which comprises an auxiliary framework attached to the main steel work of a building and made of a plurality of framework members. Each such framework member has a generally T-shaped cross section and includes an elongated central support portion defining a pair of opposed shoulders for seating the edges of a pair of adjacent infill panels. The framework member has a channel generally parallel with the support portion and shaped to receive and grip the foot of a flexible gasket, the gasket having a transverse limb adapted to extend toward or over the associated shoulder to bear against the infill. The thickness of any given infill may be substantially the same as the cross sectional length of the support portion of the associated framework member. The term 'curtain wall' as used herein is intended to cover systems of this type as well as conventional curtain wall systems.

One advantage of the system above described is the flexibility accorded the system to enable subsequent alterations and/or extensions to be accommodated. Thus the removal of one gasket allows its associated infill to be removed and replaced with, for example, an infill bearing an opening window, without disturbing adjacent infills or retention devices. (The term "infill" includes a construction panel, glazing unit, or the like which is capable of being used as cladding for a building, that is to constitute the internal and/or external walling for a building).

With the above system, and indeed with other curtain walling systems, if it is desired to have an opening window an infill is employed which provides a frame for the window and, within the frame, the glazed portion which may be arranged to open in any conventional manner. While this is perfectly satisfactory from the practical point of view, buildings built with curtain walling systems often have a striking visual appearance and many architects do not like to detract from the external sight lines of the infill retention method by an increase in the visible dimensions of the window framing member. One way of accommodating this is to build an infill panel which is oversize so that the opening portion of the window within it matches the size of the remaining infill panels, and to fit the panel by physically cutting away the framework members to accommodate the oversize infill panel. This is clearly disadvantageous since it involves extra labour. Furthermore, it destroys the flexibility of the system since, having once altered the framework to accommodate the oversize panel, it is no longer capable of accepting normal infill panels. Common external sight lines can be achieved by a large increase to the aluminium grid width dimensions thus concealing the window frame. Such an approach is expensive and inflexible. Interchangeability of infill components cannot be achieved without major alteration to the aluminium grid.

The invention seeks to provide a concealed opening window for use with curtain wall systems.

According to the present invention there is provided an opening window for use with curtain wall systems comprising an outer frame adapted to fit to the framework members of the curtain wall systems and an inner frame bearing the glazed portion of the window, the inner frame and the outer frame being hingedly attached to one another and the glazed portion extending so as to be substantially coextensive with the outer frame.

In order to hold the outer frame within the framework and at the same time avoid obstructing the opening portion, the gasket is preferably modified as described more fully hereinafter.

The invention will be described by way of example, with reference to the accompanying drawings, in which.

Figure 1:
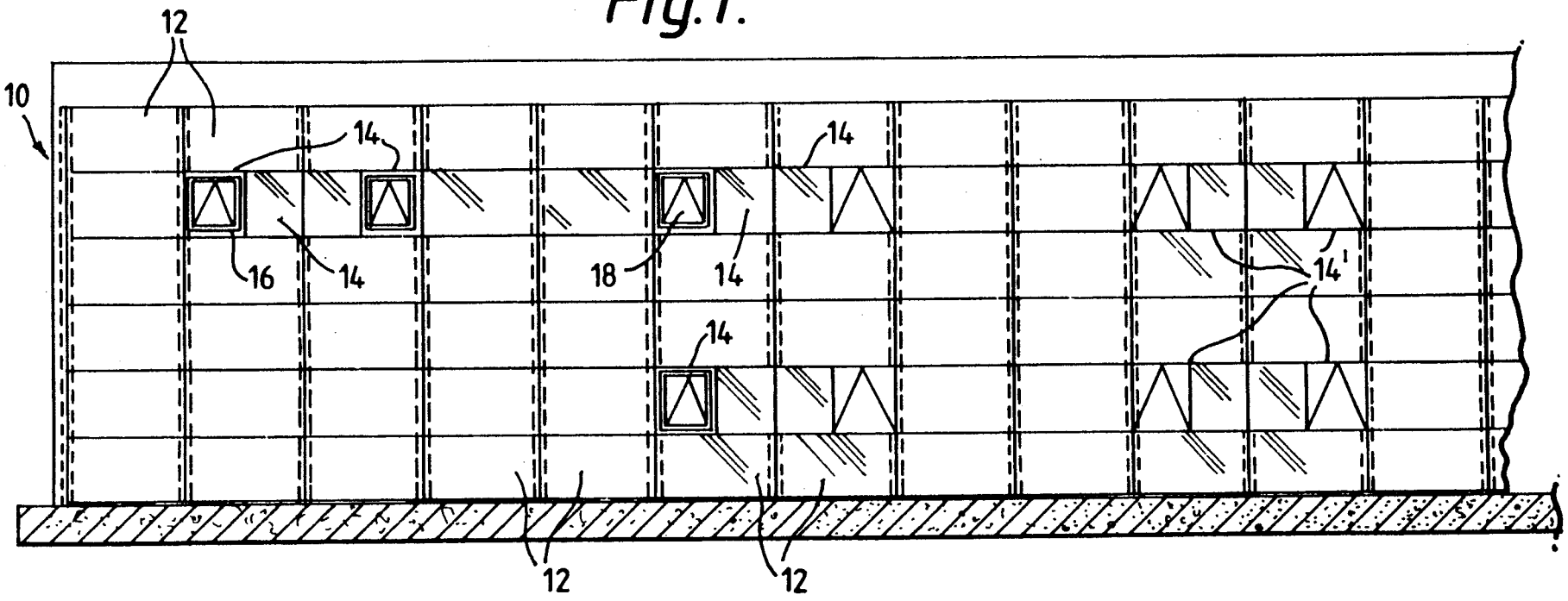
FIG. 1 is a view of a typical curtain wall building illustrating both conventional windows and windows in accordance with the invention.

Referring to the drawings, a wall generally designated 10 constructed from a curtain walling system comprises a number of infill panels 12 some of which 14 are glazed. Within the glazed panels 14 there are opening windows 16. As can be seen from FIG. 1 the opening portions 18 of the windows do not extend to the edges of the infill and thus break up the sight line of the wall as viewed. However the windows 14' in accordance with the invention do not detract from the lines of the system.

Figure 2:
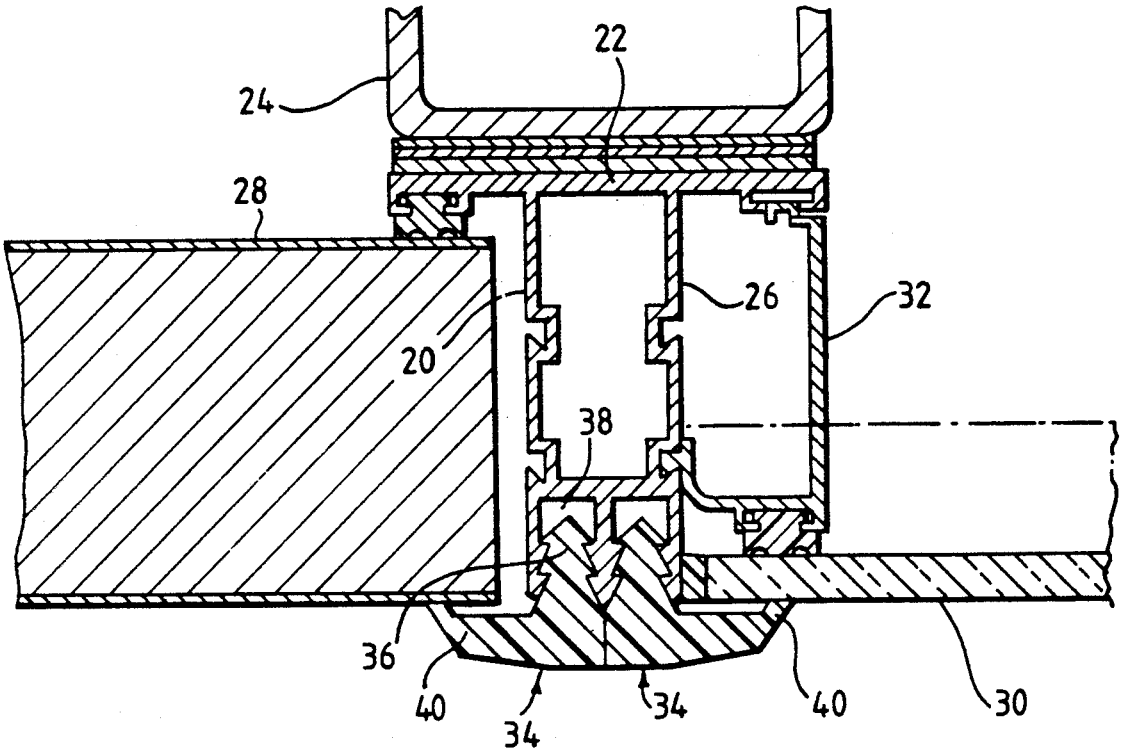
FIG. 2 is a sectional view of conventional framework and infill members.
Figure 3:
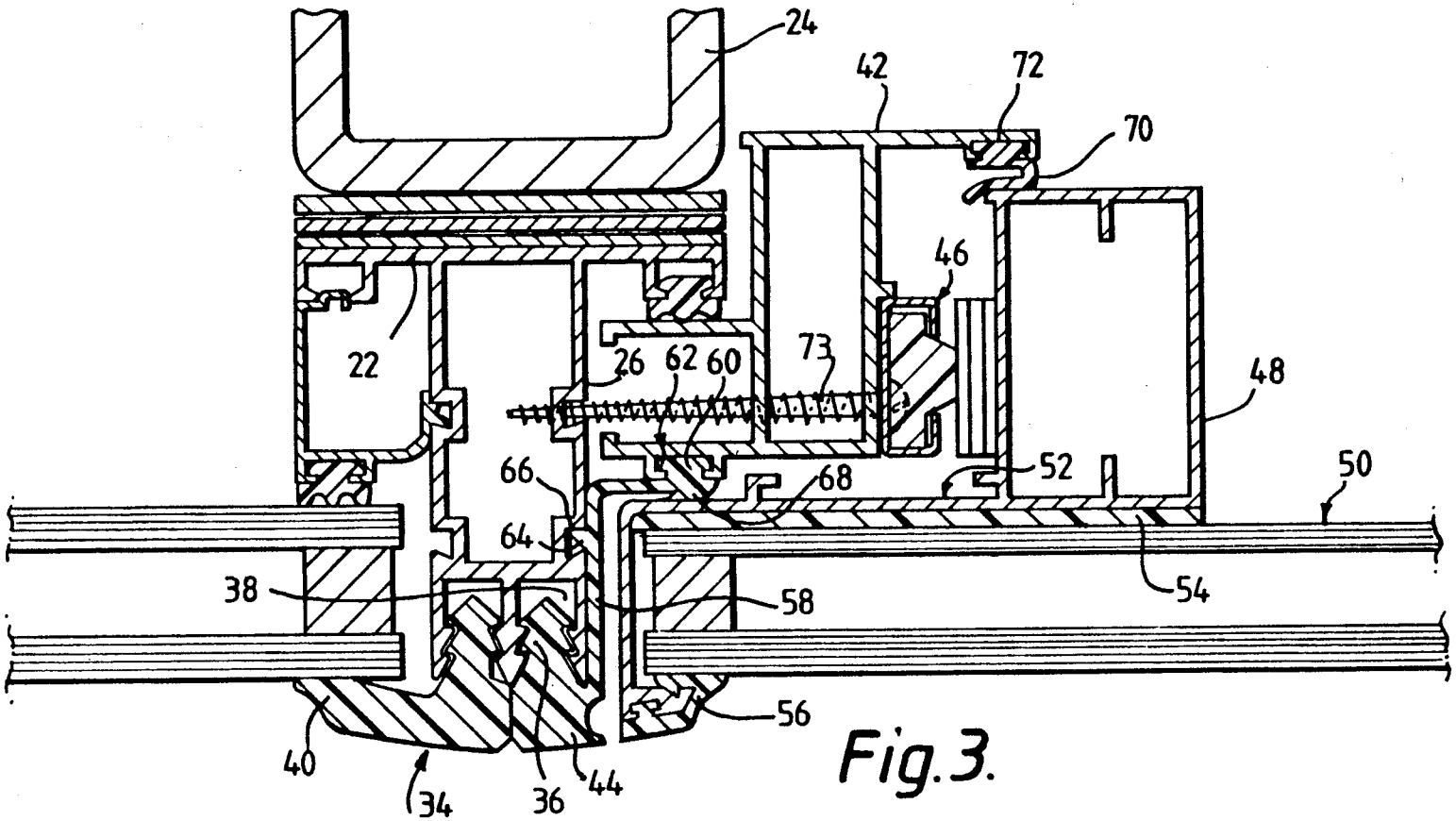
FIG. 3 is a partial sectional view, similar to FIG. 2, showing the window of the invention.

FIGS. 2 and 3 illustrate the curtain walling system of our above mentioned US patent and of this invention, respectively, each of which comprises a framework member 20 including a web 22 which is substantially planar and is bolted back to a structural steelwork member 24. Extending from the web 22, as shown in FIG. 2, is a central support portion 26, opposite sides of which define a pair of shoulders for receiving conventional infills 28, 30. As illustrated in FIG. 2 the infill 28 is of substantially the same thickness as the frame member 22 whereas the infill 30 is considerably thinner, for example a single pane of glass, and a spacing member 32 is employed to take up the gap. In both cases the infills are held in place by means of gaskets 34 each of which has a 'foot' 36 adapted to be received in a channel 38 in the support member 26 and be retained there by relative engagement of teeth or serrations as illustrated. Each gasket 34 has an arm or limb 40 extending transversely from the foot and adapted to overlie the proximate edge region of the outer face of the associated infill panel 28, 30 and adapted to bear against and pressingly engage the infill panel and hold it in place.

Turning now to FIG. 3, the right hand half of a frame member similar to that shown in FIG. 2 is illustrated bearing an openable window in accordance with the invention. Like numerals are employed for like parts. The window comprises an outer frame 42 adapted to sit on the shoulder formed by the support portion 26 and be sealed by a modified gasket 44 which will be described more fully hereinafter. Attached to the outer frame 42 by means of a conventional hinge mechanism 46 is an inner frame 48 which carries the glazed portion of the window, in this case a double glazed unit. The frame 48 has a limb 52, generally L shaped in section, which extends around the glazed portion 50 and, together with resilient gasket 56 grips the glazed portion 50. There is provided a cellular tape 54 for enabling the glass to bed on to the limb 52.

The gasket 44 has a foot 36 engageable in the channel 38 in a similar manner to the gasket 34 but has no limb 40 since this would interfere with the opening of the glazed portion 50 of the window. Instead, the gasket 44 has an elongate section 58 which follows the general line of the shoulder on the support portion 26 and has an oversize bead portion 60 capable of engaging with the corresponding channel 62 formed on the outer frame 42. The section 58 also has a bead 64 for interengagement with the channel 66 in the support portion 26.

An upstanding portion 68 of the limb 58 provides a seal against the back of the elongate s 52 of the inner frame while a gasket 70 held in a in the outer frame 42 seals against the back of the inner frame 48.

The outer frame 42 is held in place on the shoulder of the support portion 26 by means of self tapping screws 73. The inner frame 48 supports the glazed port 50 while extends beyond the boundaries of the frame 48, i.e. at the external side thereof at which the gasket 56 is located, so as to be substantially coextensive with the external side of the outer frame 42 at which the modified gasket 44 is located. As can be observed from FIG. 3, the sealing gasket 56 attached to the distal end of the L-shaped portion 52 when taken together with the main portion of the gasket 44 resembles in section gasket 34 with its limb 40. Thus the gaskets 44 and 56 have the same overall appearance as the unitary gasket 34. Thus the opening window is effectively concealed and the lines of the curtain wall grid are preserved.

In use, the window, that is the glazing portion 50 carried on its inner frame 48, can be opened by hinging or pivotting on the conventional hinges 46 connecting it to the outer frame 42, e.g. about a pivot axis P parallel to the self-tapping screw 73 and to the glazed portion 50 as shown in FIG. 3 the glazed portion 50 tilting or swivelling outwardly away from the remainder of the structure. On closing the window it resumes the configuration illustrated in FIG. 3 with air and water seals being provided by the gasket portions 68 and 70 between outer frame 42 and inner frame 48.

Figure 4:
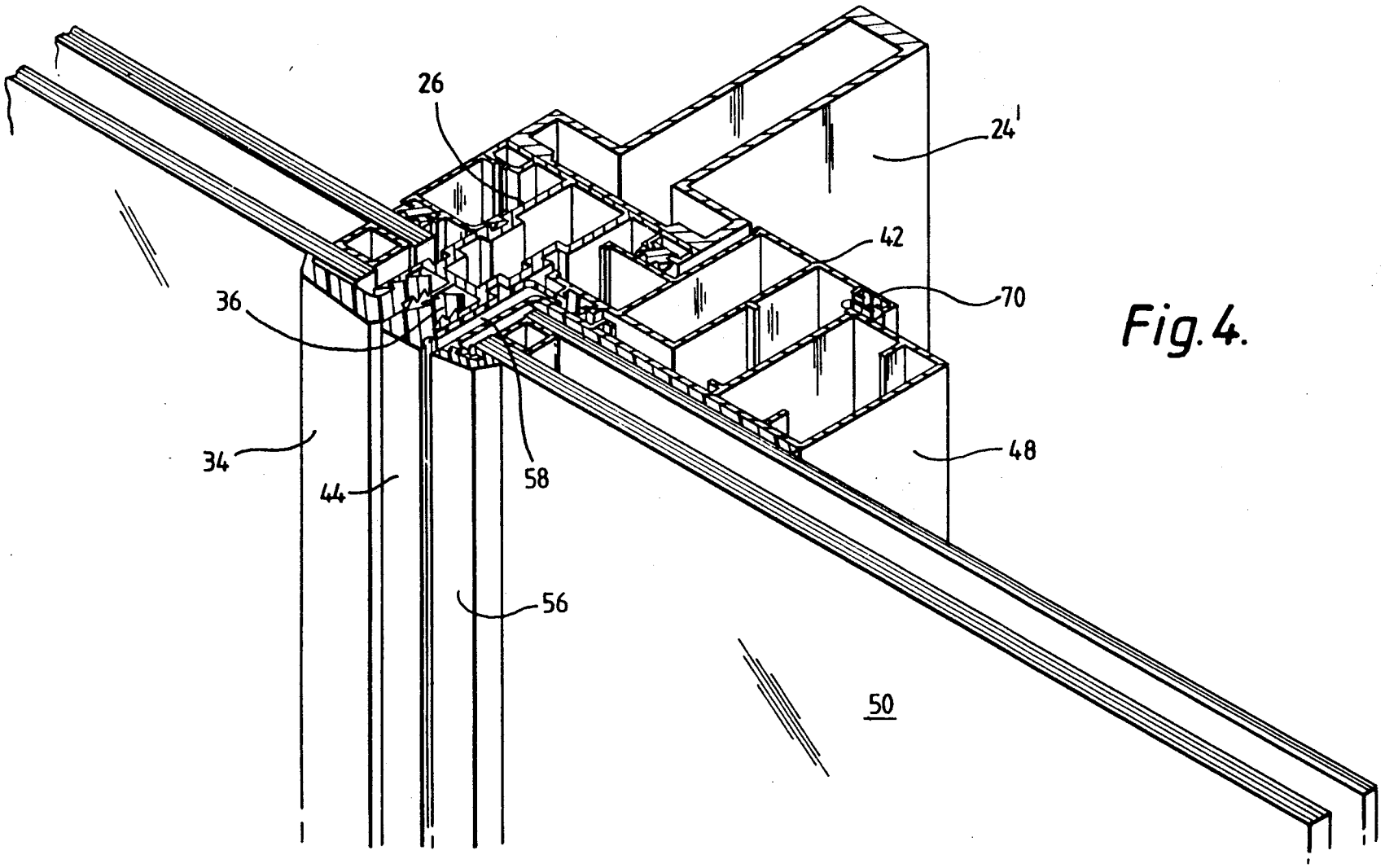
FIG. 4 is a perspective sectional view, similar to FIG. 3, illustrating the window of the invention in a conventional curtain wall system.

FIG. 4 illustrates the window of the invention on a conventional curtain wall system, and like numerals are used for like parts. The web 22 and structural steel 24 are here replaced by an integral aluminium box section 24'. Otherwise the window is as described above. Since the 'gasket' is effectively in three multicolour effects can be achieved if desired by having the gaskets 34, 44 and 56 of different colours.

The device of the invention provides a concealed opening window within a curtain wall that preserves the lines of the grid and is totally interchangeable without modification to the existing grid or interference with adjacent components and their retention members.

I claim:

1. An opening window for use with curtain wall systems comprising an outer frame having an external side and being adapted to fit to the framework members of the curtain wall system, and an inner frame having an external side and forming the movable opening portion of the window and bearing the glazed portion of the window, the inner frame being positioned within the outer frame and being hingedly attached thereto, and the outer edge of the glazed portion extending outwardly beyond the boundaries of the inner frame at the external side thereof so as to be substantially coextensive with the external side of the outer frame, the outer frame carrying a first gasket and the outer edge of the glazed portion carrying a second gasket, both gaskets being arranged so tat they together give the appearance of an infill retaining unitary gasket at the external side of the outer frame.

2. The window of claim 1 wherein the first gasket has a foot engageable in a channel in a frame work member.

3. The window of claim 1 wherein the second gasket cooperates with an L-shaped member to grip the outer edge of the glazed portion.

4. The window of claim 1 wherein the first gasket has an elongate section which follows the general line of a shoulder on a framework member.

5. The window of claim 4 wherein the elongate section has an upstanding portion to seal against the back of the inner frame.

* * * * *